US006895857B2

(12) United States Patent
Weschenfelder

(10) Patent No.: US 6,895,857 B2
(45) Date of Patent: May 24, 2005

(54) PRINTING UNIT OF A WEB-FED PRINTING PRESS WITH DRIVEN CYLINDER PAIRS

(75) Inventor: Kurt Johannes Weschenfelder, Zell/Main (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/380,474

(22) PCT Filed: Sep. 17, 2001

(86) PCT No.: PCT/DE01/03560

§ 371 (c)(1),
(2), (4) Date: Mar. 20, 2003

(87) PCT Pub. No.: WO02/24454

PCT Pub. Date: Mar. 28, 2002

(65) Prior Publication Data

US 2004/0035309 A1 Feb. 26, 2004

(30) Foreign Application Priority Data

Sep. 20, 2000 (DE) ..... 100 46 374
Sep. 20, 2000 (DE) ..... 100 46 373

(51) Int. Cl.[7] ..... B41F 5/00; B41F 7/02; B41F 9/00

(52) U.S. Cl. ..... 101/216; 101/217; 101/218; 101/183

(58) Field of Search ..... 101/177–178, 101/183, 467, 216–218, 137, 174, 228, 484–485, 247, 148, 230; 347/15

(56) References Cited

U.S. PATENT DOCUMENTS 4,208,963 A * 6/1980 Dahlgren ..... 101/141
5,046,416 A * 9/1991 Freyer et al. ..... 101/148
5,142,978 A * 9/1992 Borel ..... 101/177
5,179,899 A * 1/1993 Burger et al. ..... 101/181
5,184,551 A * 2/1993 Wallmann et al. ..... 101/219
5,429,051 A * 7/1995 Laubscher ..... 101/417
5,699,735 A * 12/1997 Stein et al. ..... 101/219
5,842,414 A * 12/1998 Yoshida et al. ..... 101/136
5,907,999 A * 6/1999 Lusar et al. ..... 101/484
5,983,793 A 11/1999 Volz et al. ..... 101/216
5,983,794 A * 11/1999 Emery ..... 101/217
6,009,807 A * 1/2000 Yoshida et al. ..... 101/177
6,101,944 A * 8/2000 Schmid et al. ..... 101/467
6,138,566 A * 10/2000 Sakamoto ..... 101/463.1
6,205,926 B1 * 3/2001 Dufour ..... 101/492
6,321,967 B1 * 11/2001 Michalik et al. ..... 226/91

(Continued)

FOREIGN PATENT DOCUMENTS

| | | |
|---|---|---|
| DE | 44 30 693 A | 3/1996 |
| DE | 196 03 663 A1 | 8/1997 |
| DE | 196 40 649 A1 | 4/1998 |
| DE | 197 23 043 A1 | 12/1998 |
| DE | 197 32 330 A1 | 2/1999 |
| DE | 198 22 893 A1 | 11/1999 |
| EP | 0 699 524 A2 | 3/1996 |
| EP | 0 699 524 A3 | 2/1997 |
| EP | 0 867 279 A1 | 9/1998 |
| EP | 0 906 825 A2 | 4/1999 |
| EP | 0 997 273 A2 | 5/2000 |

OTHER PUBLICATIONS

"Digitaler Direktantrieb an Druckmaschinen," Druckspiegel, Sep. 1999, pp. 53–56.

*Primary Examiner*—Andrew H. Hirshfeld
*Assistant Examiner*—Wasseem H. Hamdan
(74) *Attorney, Agent, or Firm*—Jones, Tullar & Cooper, PC

(57) ABSTRACT

A printing unit has at least five cylinders in one of the printers. At least two of these cylinders rotate independently of each other. At least one of these cylinders has a rotational speed that is different from a zero rotational speed and is also different from a production rotational speed.

53 Claims, 6 Drawing Sheets

Figure 1:
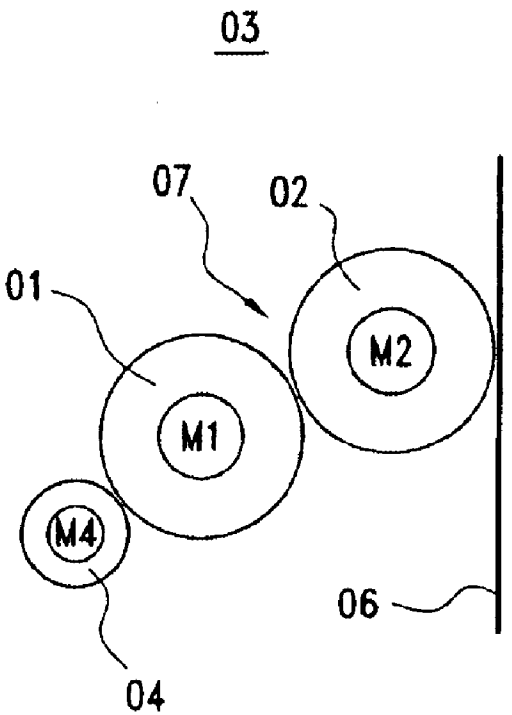

U.S. PATENT DOCUMENTS 6,332,397 B1 * 12/2001 Bolza-Schunemann et al. ..... 101/183
6,334,389 B1 * 1/2002 Fischer ..... 101/216
6,338,298 B2 * 1/2002 Schneider et al. ..... 101/179
6,393,987 B1 * 5/2002 Bolza-Schunemann et al. ..... 101/483
6,408,748 B1 6/2002 Hajek et al. ..... 101/177
6,422,141 B2 * 7/2002 Yoshida ..... 101/211
6,539,863 B2 * 4/2003 Shiraishi ..... 101/365
6,644,184 B1 * 11/2003 Hajek et al. ..... 101/177
6,651,556 B2 * 11/2003 Richards ..... 101/178
6,736,060 B2 * 5/2004 Masuch ..... 101/177
2004/0050275 A1 * 3/2004 Masuch ..... 101/349.1

* cited by examiner

PRINTING UNIT OF A WEB-FED PRINTING PRESS WITH DRIVEN CYLINDER PAIRS

FIELD OF THE INVENTION

The present invention is directed to a printing unit. The printing unit has at least five cylinders. First and second cylinder pairs each include a forme cylinder and a transfer cylinder. The two transfer cylinders cooperate with a common satellite cylinder in a print-on position.

BACKGROUND OF THE INVENTION

In U.S. Pat. No. 6,332,397 A1, a five-cylinder printing unit has an operational state in which one of the forme cylinders can be stopped for a plate change. The associated transfer cylinder is either also stopped, or can be rotated, together with the forme cylinder, independently of the remaining three cylinders.

SUMMARY OF THE INVENTION

The object of the present invention is directed to providing a printing unit.

In accordance with the present invention, this object is attained by providing the printing unit with at least five cylinders which include two cylinder pairs, each including a forme cylinder and a transfer cylinder. The two transfer cylinders cooperate with a common satellite cylinder during printing. At least the two cylinders in each pair are driven by their own drive motors, with no drive connections to the remaining cylinders, both in a set-up operation, as well as during production. The satellite, transfer and forme cylinders are each capable of running at rotational speeds which are independent of each other and which are varied in response to operating requirements.

The advantages which can be obtained by the present invention reside, in particular, in that a large operational diversity and variability of a printing unit or of a cylinder assembly is created.

For example, it is possible, in this way, to move cylinders or groups of cylinders independently of each other at different rotational speeds, and also in different directions of revolution, which may be required, for example, for a printing forme or for a rubber blanket change, when drawing in a paper web, or in the course of independent inking or washing of rollers and cylinders. In particular, different actions when setting up at set-up rotational speeds, or speeds different from the stop or zero rotational speed, or the production rotational speed for the individual cylinder types are therefore possible next to each other and with a paper web running or stopped.

The simultaneous meeting of several different demands placed on different components of a printing group or a printing unit in accordance with the present invention is particularly advantageous. For one, the different operational modes contribute to time savings and therefore to a lowering of the production costs, and furthermore make possible the performance of various set-up operations at production speed or at a draw-in speed of the running paper web. A flying plate change for a single- or a doubled-sided imprint operations is possible. For example, in advantageous operational states, a printing forme can be is changed or pre-inked, while the associated transfer cylinder continues to rotate at production speed, or washing, pre-inking or also a change of the dressing can also take place.

Various options for setting-up the cylinders, without one option having an effect on the others, are available, in particular for printing units having a counter-pressure cylinder, which may be for example embodied as a steel cylinder. While the imprinting of the paper web is continued at production speed, for example one cylinder can undergo a flying plate change/imprint operation. The cylinder can also be changed while the web is drawn in at a draw-in speed during a production start, or is stopped for set-up work. This applies to five-cylinder and seven-cylinder printing units, and to a certain degree to nine- and ten-cylinder printing units. These printing units permit, together with the operating modes, or operating states, in accordance with the present invention, a guidance of the paper web at draw-in or production speeds, while set-up work can be performed, some of it simultaneously, at the forme and/or transfer cylinders of one or several pairs. The modes of operation, in the same way, permit the performance of set-up work, such as, for example washing and/or changing of dressings or printing formes, pre-inking or dry running, to accomplish, for example de-inking the cylinders, with the paper web stopped and without it being negatively affected.

For example, a Y- or a lambda-shaped six-cylinder printing unit can be flexibly employed for a 2/1 print run, or also for a flying plate change, or for an imprint function during 1/1 printing, if one of the forme cylinders is operated at a rotation speed and in a direction of rotation for the change, while all remaining cylinders rotate at production rotational speed. The transfer cylinder assigned to the forme cylinder to be changed is, for example, being operated, at the same time, at a rotational speed and in a direction of rotation for washing, or for other set-up functions. This correspondingly also applies to an above mentioned seven-, nine- or ten-cylinder printing unit.

For reasons of flexibility and of savings of time, as well as of waste, the operational states are of great importance in the course of fitting prior to start-up of the printing unit, or at the end of the printing operation. For example, the forme cylinder and the transfer cylinder can simultaneously be operated in, or pass through different set-up programs.

Besides the simultaneous operating modes at different rotational speeds of the cylinders and rollers made possible by the present invention, the operating modes in different directions of rotation is of benefit. In particular, in connection with printing units which can be changed from a rubber-against-steel to a rubber-against-rubber operation, the change from a first direction of rotation to a second direction of rotation is of great advantage.

Also advantageous is the capability of an independent operation of the rollers associated with the forme cylinders for ink application. For example, washing or pre-inking can take place independently of the rotational speed or of the direction of rotation, while the forme cylinder also passes through a set-up program.

Preferred embodiments of the present invention are represented in the drawings and will be explained in greater detail in what follows.

Figure 3:
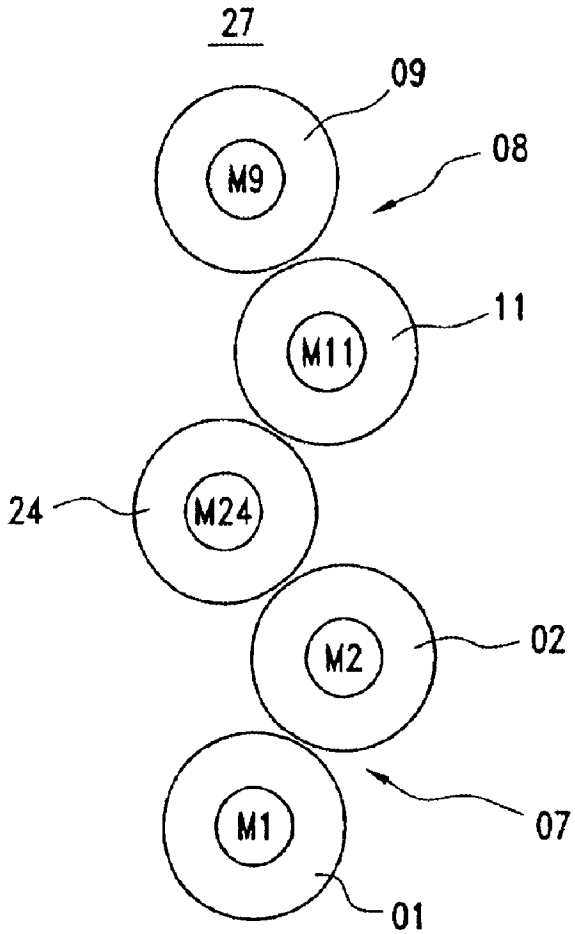
Figure 2:
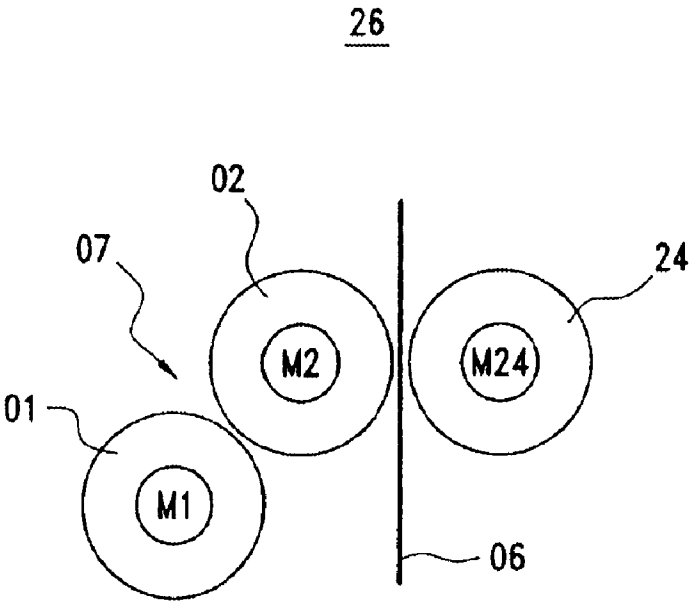
Figure 5:
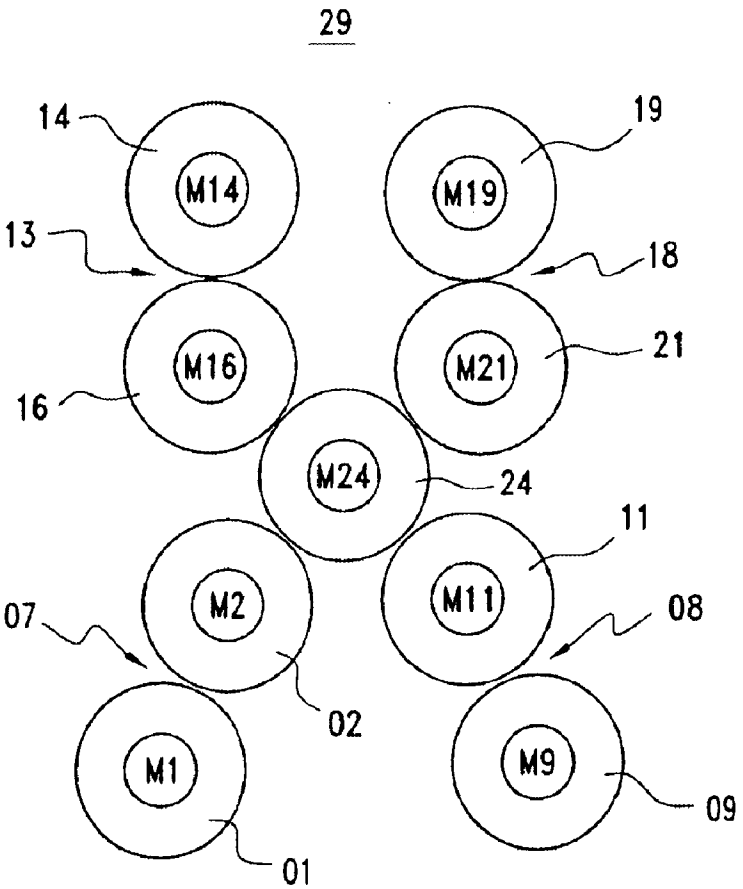
Figure 4:
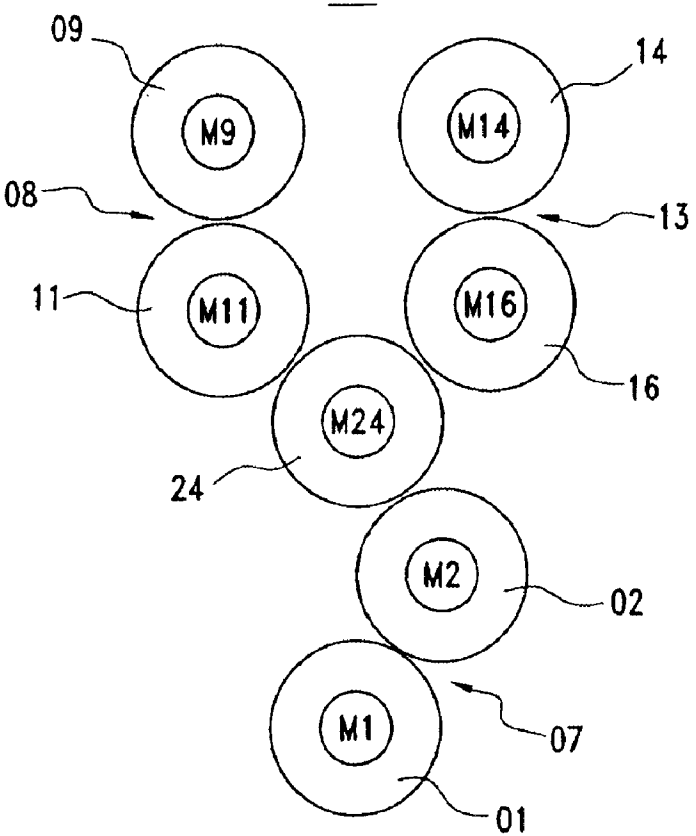
Figure 6:
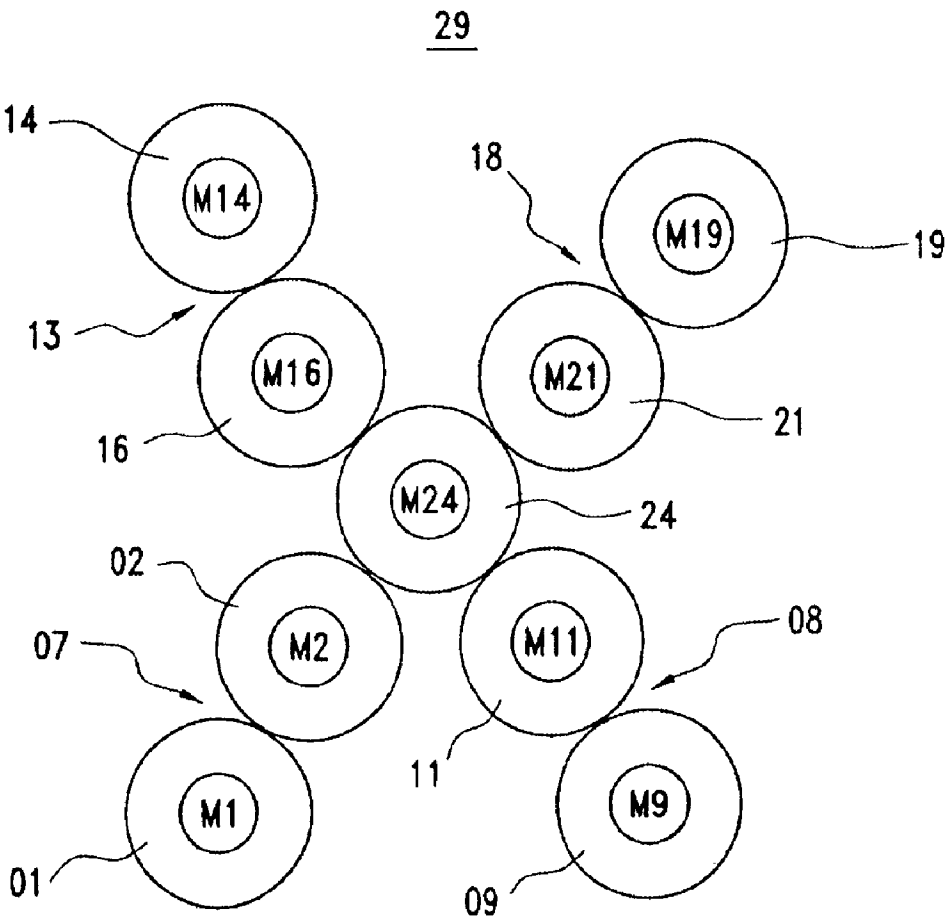
Figure 7:
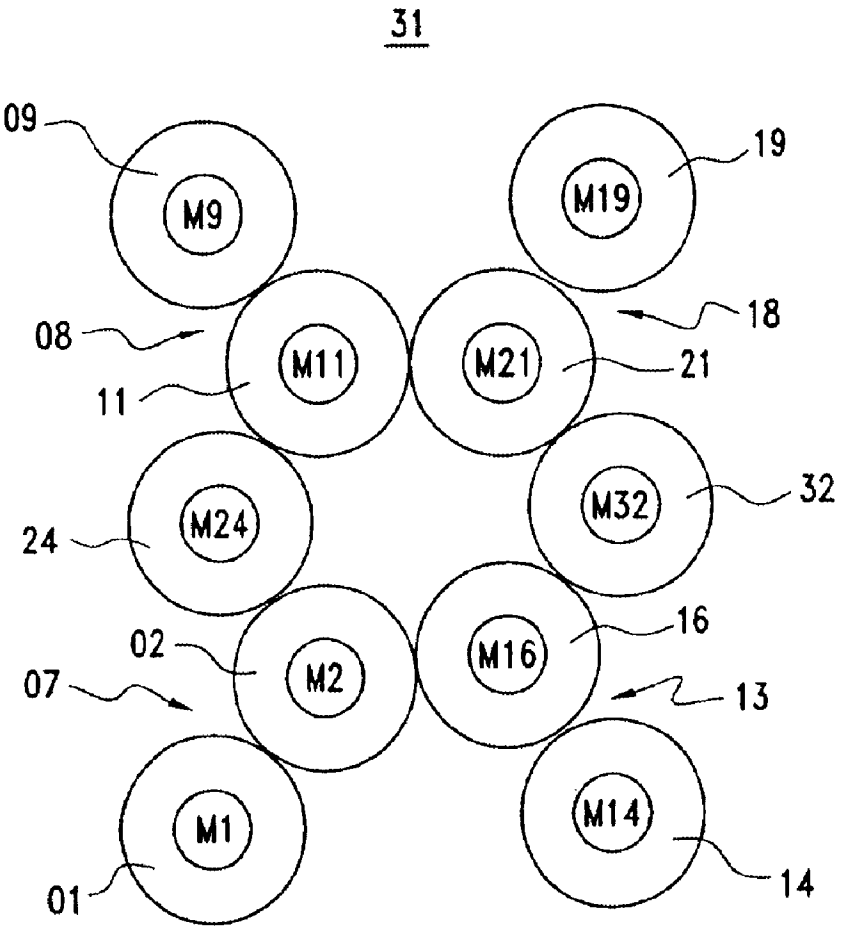
Figure 8:
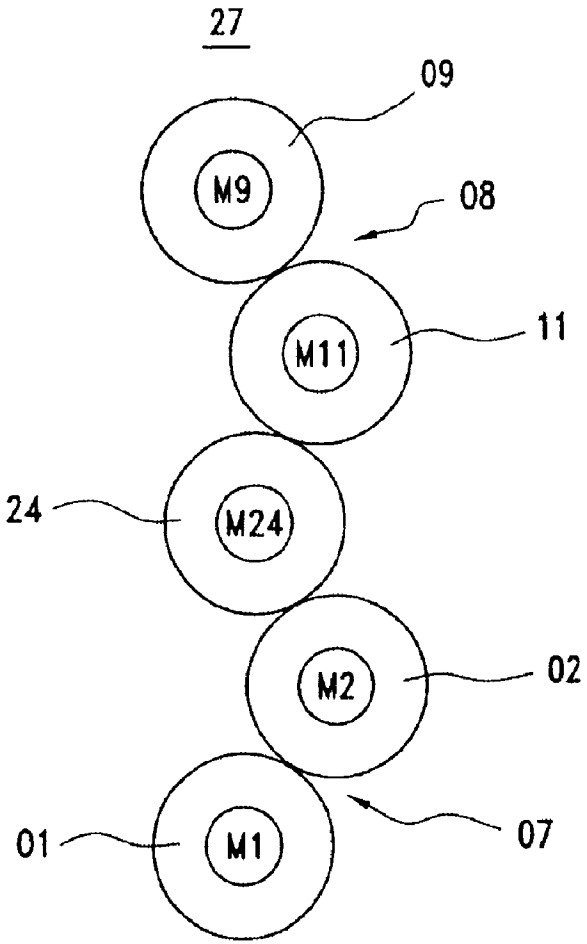

Shown are in:

FIG. 1, a schematic side elevation view of a forme and transfer cylinder of a printing group with an associated inking roller in accordance with the present invention, FIG. 2, a schematic side elevation view of a three-cylinder printing unit, FIG. 3, a schematic side elevation view of a five-cylinder printing unit, FIG. 4, a schematic side elevation view of a seven-cylinder printing unit, FIG. 5, a schematic side elevation view of a nine-cylinder printing unit, FIG. 6, a schematic side elevation view of a nine-cylinder printing unit with the forme and transfer cylinders moved away, FIG. 7, a schematic side elevation view of a ten-cylinder printing unit, and in FIG. 8, a schematic lateral view of a five-cylinder printing unit with the forme and transfer cylinders moved away.

DESCRIPTION OF THE PREFERRED EMBODIMENTS

A printing unit of a printing press, in particular a rotary printing press, as seen in FIG. 1, has a first cylinder 01, for example a forme cylinder 01, and a second cylinder 02 cooperating in a print-on position, for example a first transfer cylinder 02 of a printing group 03. The forme cylinder 01 can cooperate with an inking roller 04, in particular an ink application roller 04, or a screen roller 04, or an anilox roller 04. In a print-on position, the transfer cylinder 02 cooperates with a web 06, for example a web 06 of material to be imprinted, and in particular a paper web 06.

The forme cylinder 01 can be rotated independently of the transfer cylinder 02 by a motor M1. As a function of the operational state of the printing group 03 the forme cylinder 01 rotates, at times, at rotational speeds and/or in directions of rotation which are different from the rotational speeds and/or directions of rotation of the transfer cylinder 02. The transfer cylinder 02 also, at times, rotates independently of the forme cylinder 01 and is driven by a drive motor M2.

In the discussion which follows, the operational states are defined in terms of rotational speed or effective circumferential speed on the cylinder surfaces, and are called "speeds" for short in what follows. The operational states referenced by use of the term "rotational speed" are to be applied in the same way to the term "speed".

The forme cylinder 01 can take up one or several of the following operational states: it can be stopped. As such, it will rotate at a rotational speed "zero" FZRS. It can also rotate at a production rotational speed FPRS or at a set-up rotational speed FSRS which, as a rule, is different from the stopped state FZRS and the production rotational speed FPRS.

The set-up rotational speed FSRS, in turn, can be a rotational speed FPFCRS suitable for a change of the printing forme, a rotational speed FPIRS for use during pre-inking, or a rotational speed FWRS for accomplishing washing. A further set-up rotational speed FSRS can also be a rotational speed FDRRS for dry running, i.e. for use during the ink removal from the forme cylinder 01 onto the web 06, or a rotational speed FDIRS for drawing in the web 06. In a case of a direct image transfer to the surface of the forme cylinder 01 or onto the printing forme on the forme cylinder 01, the set-up rotational speed FSRS can also represent a rotational speed FITRS for image transfer.

The transfer cylinder 02 can also assume one or several of the following operational states. It can be stopped so that it rotates at a rotational speed "zero" TZRS. It can rotate at a production rotational speed TPRS or a set-up rotational speed TPRS, which, as a rule, is also different from the stop TZRS and from the production rotational speed FPRS. The set-up rotational speed TRRS can be a rotational speed TDCRS for changing the dressing, a rotational speed TDIRS for drawing in a web 06, a rotational speed TWRS for washing, or a rotational speed TPIRS for pre-inking the transfer cylinder 02.

The production rotational speed FPRS for the forme cylinder 01 lies, for example, between 20,000 and 50,000 revolutions per hour (r/h), and preferably between 35,000 to 45,000 r/h. The production rotational speed TPRS of the transfer cylinder 02 lies also between 20,000 and 50,000 r/h, and preferably at 35,000 to 45,000 r/h.

For sheet-fed printing presses, the production rotational speed FPRS, TPRS of the forme cylinder 01, or of the transfer cylinder 02 for circumferences which, for example correspond to one printed page, lies, for example, between 10,000 and 25,000 r/h.

The rotational speed FPIRS of the forme cylinder 01 characteristic for pre-inking lies, for example, in the range between 6,000 and 12,000 r/h.

The rotational speed TPIRS of the transfer cylinder 02 for pre-inking lies, for example, between 6,000 and 12,000 r/h.

For washing the forme cylinder 01, the rotational speed FWRS, for example, lies between 200 to 1,000 r/h, and in particular between 300 and 800 r/h, while the rotational speed TWRS for washing the transfer cylinder 02 can lie between 300 and 40,000 r/h, for example, and in particular between 300 to 6,000 r/h.

The rotational speed FDIRS, for example, of the forme cylinder 01 turning along for drawing in the web 06, lies between 600 and 2,000 r/h, for example, and in particular between 300 to 800 r/h, which speed approximately corresponds to a draw-in speed of the web 06 between 6 to 30 m/min, and in particular between 6 to 12 m/min.

The rotational speed TDIRS of the transfer cylinder 02 for drawing in the web 06 is, for example, between 300 to 2,000 r/h, and in particular is between 300 to 800 r/h, which approximately corresponds to a draw-in speed of the web 06 between 6 to 30 m/min, and in particular between 6 to 12 m/min.

For the automatic change of the printing forme, the rotational speed FPFCRS can lie between 300 r/h and 2,000 r/h, and in particular between 300 r/h and 1,000 r/h, wherein, as a rule, a reversal of the direction of rotation takes place during the changing process. However, the rotational speed FPFCRS can also lie between 120 and 300 r/h during a so-called tip operation. With a direct image transfer to the print forme or to the outer cylinder surface of the forme cylinder 01, for example by means of laserdiodes, the rotational speed FITRS of the forme cylinder 01, as a rule, lies above the production rotational speed FPRS, for example above 50,000 r/h, and in particular above 70,000 r/h for web-fed printing presses, and above 5,000 r/h, and in particular between 5,000 and 30,000 r/h, for sheet printing presses.

The rotational speed TDCRS for changing the dressing on the transfer cylinder 02 lies between 300 and 2,000 r/h, and in particular between 300 and 1,000 r/h. If the change of the dressing is manually performed, which is presently preferred, the rotational speed can also lie between 120 and 1,000 r/h.

The rotational speed FDRRS of the forme cylinder 01 for dry running, to accomplish ink removal from the forme cylinder 01, lies between 2,000 and 4,000 r/h.

The rotational speeds set forth above for forme cylinders 01 and for transfer cylinders 02 preferably relate to cylinders 01, 02 of so-called double circumference, which means to cylinders 01, 02 on whose circumference two printing forms can be fastened one behind the other in the circumferential direction. The cylinder circumferences for this are a function of the printing format and lie, for example, in a range between 900 mm and 1,300 mm. The rotational speeds of the forme cylinder 01, 02 would have to be doubled in case of the use of cylinders 01, 02 of single circumference. This also applies to printing groups 03, wherein a forme cylinder 01 of single circumference cooperates with a transfer cylinder 02 of twice or double the circumference of the forme cylinder.

For one or for several of the rotational speed ranges of the forme cylinder 01 and the transfer cylinder 02 discussed above, left or right directions of rotation are both possible. These directions of rotation are defined in the subsequent drawing figures representing side elevational views of the cylinders 01, 02.

In the discussion which follows, the mentioned operational states, as well as preferred rotational speeds, should also be applied to further forme cylinders, transfer cylinders which may be added in the course of the description.

The inking roller 04 depicted in FIG. 1, and which is embodied as a screen or anilox roller 04, or as a rubber-coated ink application roller 04, can also either be stopped, so that it either rotates at a rotational speed "zero" IZRS, or can operate at a production rotational speed IPRS, or at a set-up rotational speed RW and is driven by a motor M4. The set-up rotational speed ISRS can be a rotational speed IPIRS for pre-inking, a rotational speed IWRS for washing, or a rotational speed ICRRS for the continued running of the inking roller 04.

The preferred rotational speed ranges of the inking roller 04 are a function of the printing process and/or the configuration of the printing unit, or of the inking system.

In the discussion which follows, a differentiation is to be made between a simple rubber-coated ink application roller 04, an anilox roller 04 or screen roller 04, as well as a screen roller 04 of twice the circumference. The inking roller 04 embodied as a simple rubber-coated ink application roller 04 preferably has approximately one-third the circumference of a forme cylinder 01 of double circumference. A screen roller 04 directly cooperating with the forme cylinder 01 can have the circumference of a forme cylinder 01 of single circumference or, in particular, in case of letterpress or flexographic printing, of a forme cylinder 01 of twice the circumference.

For example, the production rotational speed IPRS lies between 40,000 and 100,000 r/h for the anilox rollers 04 or screen rollers 04 of single circumference directly cooperating with the forme cylinder 01, and between 60,000 and 150,000 r/h in the case of the simple rubber-coated ink application roller 04. The production rotational speed IPRS of the screen roller 04 of twice the circumference lies between 20,000 and 50,000 r/h, for example.

The rotational speed IPIRS for accomplishing pre-inking of the inking roller 04 lies between 12,000 to 24,000 rlh, for example, in the case of the anilox roller 04 or the screen roller 04 of single circumference, and between 18,000 and 36,000 r/h in the case of a simple rubber-coated ink application roller 04.

For washing the inking roller 04, the rotational speed IWRS, for example lies between 600 and 1,600 r/h in the case of the anilox roller 04 or the screen roller 04 of single circumference, and between 900 and 2,400 r/h in the case of a simple rubber-coated ink application roller 04.

For continued running of the inking roller 04 to counter the drying of the ink, the rotational speed ICRRS preferably lies between 3,000 and 6,000 r/h for the screen roller 04 of twice the circumference, between 6,000 and 12,000 r/h for the screen roller 04 of single circumference, and between 9,000 and 18,000 r/h for the rubber-coated ink application roller 04.

As previously discussed, the recited operational states are also defined by effective circumferential speeds, or "speeds," for short, of the rotating bodies.

The production speed FPRS of the forme cylinder 01 lies between 6.4 and 16 m/s, for example, and in particular between 11 and 15 m/s. The same applies to the transfer cylinder 02, if provided.

The speed FACRS of the forme cylinder 01 for the automated changing of the printing forme lies between 0.32 and 0.64 m/s, for example, and for a manual change lies, for example, between 0.10 and 0.32 m/s. For pre-inking the printing forme, the speed FPIRS of the forme cylinder 0.1 lies, for example, between 1.9 and 3.9 m/s, while for washing of the printing forme FWRS, it lies between 0.06 and 0.32 m/s, for example, and in particular between 0.10 and 0.26 m/s. For dry running FDRRS of the printing forme, the speed of the forme cylinder 01 lies, for example, between 0.64 and 1.3 m/s. As a rule, the speed of the forme cylinder 01 for image transfer FITRS is greater than 16 m/s, and in particular is greater than 22 m/s for web-fed printing presses, and for sheet-fed printing presses the speed is greater than 1.6 m/s, and in particular is between 1.6 and 9.6 m/s. For drawing in the web 06, the speed FDIRS of the forme cylinder 01 lies, for example, between 0.10 and 0.50 m/s, and in particular lies between 0.10 and 0.2 m/s.

The same values, or ranges, are advantageous for the transfer cylinder 02 as those for the forme cylinder 01 for the respective operational states of pre-inking TPIRS, changing the dressing TDCRS and drawing in the web TDIRS. The speed TDCRS of the transfer cylinder 02, for a manual changing of the dressing, lies between 0.04 and 0.32 m/s. During washing TWRS of the transfer cylinder 02, its speed lies, for example, between 0.10 and 13 m/s, and in particular lies between 0.10 and 1.9 m/s.

The speeds of the inking roller 04, in the operational states where it is placed against the forme cylinder 01, are based on the speed of the latter, so that, for example, the production speed IPRS of the inking roller 04 also lies in the range between 6.4 and 16 m/s, and in particular between 11 and 15 m/s. If the inking roller 04 is embodied as a screen roller 04, its circumference can then approximately correspond to the circumference of a forme cylinder 01 of single circumference, for example. If the circumference of the screen roller 04 has been selected to be greater, for example between 1.0 and 1.2 m, the rotational speeds IPRS should be selected to be less. This correspondingly applies in case the inking roller 04 is embodied as an ink application roller 04, wherein the rotational speed to be selected is again a function of the inking roller 04, which, for example, lies between 0.35 and 0.5 m.

For pre-inking, the speed of the inking roller 04 lies, for example, between 1.9 to 4.0 m/s, and for washing it lies between 0.08 and 0.3 m/s. For continued running, the speed of the inking roller 04 lies, for example, between 0.95 and 1.95 m/s.

In the situation where the circumference of the screen roller 04 lies in the lower circumferential range or below, such as is advantageous, for example, in case of a double-sized forme cylinder 01 during direct printing operations, in an advantageous embodiment, the above recited ranges of the rotational speeds for the screen roller 04 should be increased by the appropriate rotational speed, for example by 0 to 30%, and in particular by 10 to 20%, so that the advantageous range for the speed is approximately maintained.

Suitable, or desired rotational speeds for the rotating bodies 01, 02, 04 discussed above, which rotating bodies are embodied as cylinders 01, 02 and rollers 04, can be determined by use of the advantageous speeds, if the effective circumferences for various diameters are known.

In the drawing figures, the rollers 04 are depicted schematically and are represented with a uniform diameter for the sake of simplicity. The operational states are described in terms of rotational speeds in the preferred embodiments. However, the same preferred embodiments, or examples, can also be read from the speeds characterizing the operational speeds.

To limit the number of drawing figures, the arrangement of the cylinders 01, 02 and rollers 04 in FIGS. 1 to 5 and 7 is represented wherein they are spaced apart from each other. The states of cylinders 01, 02, or rollers 04, which are placed against or away from each other, ensue from the descriptions of the preferred embodiments and they can therefore not be taken from the mentioned drawing figures alone. FIGS. 6 and 8 represent states described in the examples or embodiments for placing cylinders, or rollers, against or away from each other.

A first group of examples or operational states are depicted in FIG. 1 and comprise first to seventh examples and describe advantageous operational states for a first cylinder pair 07 consisting of the forme cylinder 01 and the cooperating transfer cylinder 02.

The forme cylinder 01 can have a cooperating inking roller 04, which is either coupled with it or, in an advantageous manner, also rotates independently of the forme cylinder 01.

In a first example, the forme cylinder 01 rotates at the rotational speed FPIRS for pre-inking, while the transfer cylinder 02 rotates at the rotational speed TRRS corresponding to the rotational speed TWRS for washing the transfer cylinder.

In a second example, the forme cylinder 01 rotates at the rotational speed FPIRS for pre-inking, while the transfer cylinder 02 rotates at the set-up rotational speed TRRS corresponding to the rotational speed TDIRS for drawing in the web 06.

In a third example, the forme cylinder 01 rotates at the rotational speed FSRS, in this case at the rotational speed FPFCRS for changing the printing forme. At the same time, the transfer cylinder 02 rotates at the rotational speed TDIRS for drawing in the web 06. In the case of a direct image transfer to forme cylinder 01, the forme cylinder 01 rotates at the rotational speed FITRS for transferring images to the forme cylinder 01.

In the fourth example, the forme cylinder 01 rotates at the rotational speed FPF for changing the printing forme, while the transfer cylinder 02 rotates at the rotational speed TWRS for washing. Here too, in the case of a direct image transfer to forme cylinders 01, the latter can alternatively rotate at the rotational speed FITRS for image transfer. The forme cylinder 01 and the transfer cylinder 02 are moved away from each other. The inking roller 04 is moved away from the forme cylinder 01 and, for example, rotates also at the set-up speed rotational ISRS, the rotational speed IPIRS for pre-inking, the rotational speed IWRS for washing the inking roller 04, or the rotational speed ICRRS for continued running of the inking roller 04 for preventing it from drying out.

In the fifth example, the forme cylinder 01 rotates at the rotational speed FPFCRS for changing the printing forme, or alternatively at the rotational speed FITRS for the direct transfer of images, while the transfer cylinder 02 rotates at the rotational speed TDCRS, which is suitable for changing the dressing on the transfer cylinder 02. The forme cylinder 01 and the transfer cylinder 02 are moved away from each other. The inking roller 04 is moved away and is, for example, in the stopped state IZRS.

In the sixth example, the forme cylinder 01 is in the stopped state FZRS, while the transfer cylinder 02 rotates at the rotational speed TDIRS for drawing in the web 06. The inking roller 04 can be in or out of contact.

In the seventh example, the forme cylinder 01 is also in the stopped state FZRS, while the transfer cylinder 02 rotates at the rotational speed TWRS for washing the transfer cylinder 02. Here, too, the inking roller 04 can be in or out of contact.

The transfer cylinder 02 of the cylinder pair 07 cooperates in a print-on position, via the web 06 with a cylinder 24, which cylinder 24 may be, for example, a counter-pressure cylinder 24, or a satellite cylinder 24, in particular a steel cylinder 24, and constitutes a three-cylinder printing unit 26, as shown in FIG. 2. In principle, all operational states in the first to seventh examples are possible for the cylinder pair 07. The steel cylinder 24 can be in the stopped state, in which it rotates at a rotational speed "zero" SZRS; at a production rotational speed SPRS, or at a set-up rotational speed SSRS and is driven by a motor M24. The set-up rotational speed SSRS of the steel cylinder 24 can be a rotational speed SDCRS for changing a dressing or a cover, a rotational speed SDIRS for drawing in the web 06, or a rotational speed SWRS for washing the steel cylinder 24, or a rotational speed SDRRS for dry running, to accomplish the ink removal from the forme cylinder 01 on the web 06.

The production rotational speed SPRS for the steel cylinder 24 lies, for example, between 20,000 and 50,000 r/h, and preferably between 35,000 to 45,000 r/h.

For changing a dressing, such as, for example a foil, on the steel cylinder 24, the rotational speed SDCRS lies between 300 and 2,000 r/h, and in particular between 300 and 1,000 r/h.

The rotational speed SDIRS of the steel cylinder 24 for drawing in the web 06, for example, lies between 300 and 2,000 r/h, and in particular between 300 to 800 r/h.

For washing the steel cylinder 24, the rotational speed SWRS lies, for example, between 200 and 1,000 r/h, and in particular between 300 and 800 r/h.

The rotational speed SDRRS for dry running lies, for example, between 2,000 and 4,000 r/h, and in particular between 2,000 and 3,000 r/h, for the steel cylinder 24.

As discussed above in connection with the forme cylinder 01 and with the transfer cylinder 02, the recited rotational speed ranges apply to cylinders 01, 02, 24 of double circumference. When employing a steel cylinder 24 of single circumference, the rotational speeds mentioned approximately double for the steel cylinder 24.

In case of a steel cylinder 24 of triple circumference which, for example, cooperates with one or two forme cylinders 01 of double circumference, in an advantageous manner the above mentioned rotational speeds of the steel cylinder 24 should be multiplied by approximately ⅔.

In the previous discussion, the various operational states are also taking the place of operational states defined by the rotational speed or by circumferential speeds, "speeds" for short.

The production speed SPRS of the steel cylinder 24, for example, lies between 6.4 and 16 m/s, and in particular between 11 and 15 m/s. The speed SDCRS of the steel cylinder 24 for changing the dressing lies, for example, between 0.32 and 0.64 m/s, while for washing SWRS of the steel cylinder 24 the speed of the steel cylinder 24 lies between 0.06 and 0.32 m/s, for example, and in particular between 0.10 and 0.26 m/s. For dry running FDRRS of the forme cylinder 01, the speed of the steel cylinder 24, for example, lies between 0.64 and 1.3 m/s. The speed SDIRS for draw-in lies, for example, between 0.10 and 0.50 m/s, and in particular between 0.10 and 0.2 m/s.

Suitable, or desired rotational speeds for the rotating body 24, embodied as a steel cylinder 24, can also be determined by use of the advantageous speeds, if the effective circumferences for various diameters are known.

What has been said above also applies with respect to directions of rotation, left and right rotation, as well as to the applicability of the rotational speed ranges, for further steel cylinders to be discussed in the subsequent description.

Some further advantageous modes of operation will be explained in what follows.

In the eighth example, the steel cylinder 24 also rotates at the rotational speed "zero" SZRS, but the transfer cylinder 02 rotates at one of its set-up rotational speeds TRRS, for example the rotational speed TWRS for washing the transfer cylinder 02. The forme cylinder 01 rotates at one of its set-up rotational speeds FSRS, for example at the rotational speed FPFCRS for changing the printing forme, or alternatively at the rotational speed FITRS for image transfer, or it is in the stopped state FZRS.

In the ninth example, the steel cylinder 24 rotates at the rotational speed "zero" SZRS, but the transfer cylinder 02 rotates at the rotational speed TDCRS for changing the dressing. The forme cylinder 01 can also rotate at its rotational speed DWFZ for changing the dressing.

In a tenth example, the steel cylinder 24 rotates at the rotational speed SDIRS for drawing in the web 06, while the transfer cylinder 02 rotates at the rotational speed TDCRS for changing the dressing. In beneficial variations, the forme cylinder 01 can rotate at one of the rotational speeds FWRS, FPFCRS, FPIRS or FITRS, or can be in the stopped state FZRS.

In a group of examples shown in FIG. 3, specifically the eleventh to the thirteenth examples, the steel cylinder 24 not only cooperates with the first cylinder pair 07, but also with a second cylinder pair 08, consisting of a second forme cylinder 09, driven by motor M9, and a second transfer cylinder 11, driven by motor M11. Together with the steel cylinder 24, the two cylinder pairs 07, 08 constitute a five-cylinder printing unit 27, for example a semi-satellite five cylinder printing unit 27. In principle, all operational states from the first to seventh examples are possible for the second cylinder pair 08, parallel with and independently of the operational state of the first cylinder pair 07. The operational states for examples eight to ten should be correspondingly applied to the cooperation and the operational modes of the second cylinder pair 08 with the steel cylinder 24. Moreover, further advantageous operational states ensue for the five-cylinder printing unit 27, which are explained in what follows.

In the eleventh example, shown in FIG. 8, the cylinders 01, 02, 09, 11 of one of the two cylinder pairs 07, 08, for example the cylinders 01, 02 of the first cylinder pair 07 and the steel cylinder 24, which have been placed against each other, rotate at the production rotational speeds FPRS, TPRS, while the second forme cylinder 09 rotates at one of its set-up rotational speeds FSRS, for example with the rotational speed FPFCRS, FWRS for changing or for washing the printing forme, or at the rotational speed FITRS for image transfer. An advantageous variation is the rotation of the forme cylinder 09 at the rotational speed FPIRS for pre-inking. However, the forme cylinder 09 can also be in the stopped state FZRS, for example. The second transfer cylinder 11 is moved away from the steel cylinder 24 and also rotates at one of its set-up speeds TRRS, for example at the rotational speed TWRS for washing the dressing.

In a twelfth example, as seen in FIG. 3, the steel cylinder 24 rotates at the rotational speed SDIRS for drawing in the web 06, which is not specifically represented in FIG. 3, while both forme cylinders 01, 09, which are moved away, rotate at one of the set-up rotational speeds FSRS, for example at the rotational speed FPIRS or FPFCRS, or FITRS, for pre-inking, or in particular for the changing of the printing forme, or image transfer. The two transfer cylinders 02, 11 are moved away from the steel cylinder 24. The transfer cylinders 02, 11 also rotate at one of their set-up rotational speeds TRRS, for example at the rotational speeds TWRS, TDCRS for washing or changing the dressing.

In the thirteenth example, as shown with reference to FIG. 3, the steel cylinder 24 is in the stopped state SZRS, while at least one of the transfer cylinders 02, 11 rotates at one of the set-up rotational speeds TRRS, for example at the rotational speeds TWRS, TDCRS for washing or for changing the dressing. In an advantageous embodiment, the associated forme cylinder 01, 09 also rotates at its set-up rotational speeds FSRS, for example the rotational speed FPFCRS for changing the printing forme, or alternatively at the rotational speed FITRS for image transfer.

In a group of examples shown in FIG. 4, specifically the fourteenth and fifteenth examples, the steel cylinder 24 cooperates not only with both cylinder pairs 07, 08. A third cylinder pair 13, consisting of a third forme cylinder 14, driven by motor M14 and a third transfer cylinder 16 driven by motor M16, has been, or can be placed against the steel cylinder 24. Together with the steel cylinder 24, the three cylinder pairs 07, 08, 13 constitute a seven-cylinder printing unit 28, for example in a Y- or a lambda-shape, for 3/0 continuous printing, or as an imprinter unit 28 for imprinting in 2/0 or 1/1 continuous printing. The latter is possible only if at least one of the transfer cylinders 02, 11, 16 can be changed from a rubber-against-steel operation to a rubber-against-rubber operation. In principle, all operational states from the first to seventh examples are possible for the third cylinder pair 13, parallel with, and independently of the operational state of the first two pairs 07, 08. The operational states of the three-cylinder printing unit 26 from examples eight to ten, as well as the operational states of the five-cylinder printing unit 27 in the examples eleven to thirteen, should be correspondingly applied to the cooperation and to the operational modes of the third cylinder pair 13 with the steel cylinder 24. Moreover, further advantageous operational states, which are explained in what follows, ensue for the seven-cylinder printing unit 28.

In the fourteenth example, two of the three cylinder pairs 07, 08, 13, for example the first and second cylinder pairs 07 and 08 with their transfer cylinders 02, 11, 16, for example the transfer cylinders 02, 11, have been placed against the steel cylinder 24 and rotate, together with the associated forme cylinder 01, 09, and the steel cylinder 24, at the production rotational speed TPRS, FPRS, SPRS. The directions of rotation of the two transfer cylinders 02, 11 are the same, for example both rotating to the left, the direction of rotation of the steel cylinder 24 is opposite, for example rotating to the right. The third forme cylinder 14 rotates at the set-up rotational speed FSRS, for example at the rotational speed FPFCRS, or alternatively at the rotational speed FITRS for image transfer. The third transfer cylinder 16 also rotates at its set-up rotational speed TRRS, for example the rotational speed TWRS for washing the dressing.

In the fifteenth example, the steel cylinder 24 rotates at a rotational speed SDIRS for drawing in the web 06, not specifically represented in FIG. 4, while the cylinders 01, 02, 09, 11, 14, 16 of at least two of the three cylinder pairs 07, 08, 13 rotate at their respective set-up rotational speed FSRS,TRRS. For example, the forme cylinders 01, 09, 14 rotate at the rotational speed FPFCRS for changing the printing forme, or alternatively at the rotational speed FITRS for image transfer.

In a group of examples shown in FIG. 5, the steel cylinder 24 cooperates as a satellite cylinder 24 in addition to the three cylinder paris 07, 08, 13 with a fourth cylinder pair 18. The fourth cylinder pair 18, consisting of the fourth forme cylinder 19, driven by motor M19 and the fourth transfer cylinder 21, which is driven by motor M21 is, or can be placed against the steel cylinder 24. Together with the steel cylinder 24, the four cylinder pairs 07, 08, 13, 18 constitute a nine-cylinder printing unit 29, for example a satellite unit 29. In principle, all operational states from the first to seventh examples are possible for the fourth cylinder pair 18, parallel with and independently of the operational state of the three cylinder pairs 07, 08, 13. The operational states of the three-cylinder printing unit 26 from examples eight to ten, the operational states of the five-cylinder printing unit 27 in the examples eleven to thirteen, as well as the operational states of the seven-cylinder printing unit 28 in the examples fourteen and fifteen should be correspondingly applied to the cooperation and to the operational modes of the fourth cylinder pair 18 with the steel cylinder 24, or with the other cylinder pairs 07, 08, 13. Moreover, further advantageous operational states, which are explained in what follows, ensue for the nine-cylinder printing unit 29.

In the sixteenth example shown in FIG. 6, the cylinders 01, 02, 09, 11, 14, 16, 19, 21 of three of the four cylinder pairs 07, 08, 13, 18, for example of the cylinder pairs 07, 08, 13, and the steel cylinder 24 rotate at production rotational speed FPRS, TPRS, SPRS. The transfer cylinders 02, 11, 16 rotate in the same direction of rotation, for example rotating to the left, and are each placed against the associated steel cylinder 24. The steel cylinder 24 and the three forme cylinders 01, 09, 14 of the pairs 07, 08, 13 rotate in an opposite direction of rotation to this first direction, for example they are all rotating to the right. The fourth forme cylinder 19 rotates at one of its set-up rotating speeds FSRS, for example the rotational speed FPFCRS for changing the printing forme, or alternatively at the rotational speed FITRS for image transfer, and is, in an advantageous manner, moved away from the cooperating transfer cylinder 21. As shown in the example, the transfer cylinder 21 is not placed against the steel cylinder 24 and also rotates at one of its set-up rotational speeds TRRS, for example the rotational speed TWRS for washing the transfer cylinder 21.

In an advantageous embodiment, the sixteenth example can be applied to a mode of operation, in which two of the four cylinder pairs 07, 08, 13, 18, or the forme cylinder 01, 09, 14, 19, or the transfer cylinders 02, 11, 16, 21 rotate at one of their set-up rotational speeds FSRS, TRRS, for example for the purpose of changing the printing forme or the dressing, at the rotational speed FPFCRS or TDCRS, for the purpose of pre-inking at the rotational speed FPIRS, or for the purpose of image transfer, at the rotational speed FITRS, while the remaining cylinders 01, 02, 09, 11, 14, 16, 21, 24 rotate at the production rotational speeds FPRS, TPRS, SPRS.

In a seventeenth example, the steel cylinder 24 rotates at the rotational speed SDIRS for drawing in the web 06, which is not specifically represented in FIG. 8, rotating, for example, to the right. The four transfer cylinders 02, 11, 16, 21 also rotate at the rotational speed TDIRS for drawing in the web 06, but in the opposite direction, for example rotating to the left. The forme cylinders 01, 09, 14, 19 rotate at one of the set-up rotational speeds FSRS, for example the rotational speed FPFCRS for changing the printing forme, or alternatively at the rotational speed FITRS for image transfer. In this case, the direction of rotation can be to the right or the left. However, only one, two or three of the forme cylinders 01, 09, 14, 19 can rotate at one of the set-up rotational speeds FSRS, while the remaining forme cylinders 19, 14, 09, 01 are in the stopped state FZRS.

In an eighteenth example shown in FIG. 7 two five cylinder printing units 27 in accordance with the eleventh to thirteenth examples constitute together a ten-cylinder printing unit 31, for example a ten-cylinder satellite 31. In this case, the two cylinder pairs 07 and 08 cooperate with the steel cylinder 24, while the two cylinder pairs 13 and 18 cooperate with a further cylinder 32, for example a second counter-pressure cylinder 32 having a drive motor M32, and in particular a satellite cylinder 32 or steel cylinder 32, constituting a second five-cylinder printing unit 27. In principle, all operational states from the first to seventh, as well as the eleventh to the thirteenth examples are possible for all four cylinder pairs 07, 08, 13, 18, or for the two five-cylinder printing units 27, parallel with, and independently of the operational state of the respectively other cylinder pairs 07, 08, 13, 18, or the other five cylinder printing unit 27.

In the eighteenth example of FIG. 7, the cylinders 01, 02, 09, 11, 14, 16, 19, 21 of three of the four cylinder pairs 07, 08, 13, 18, for example the pairs 07, 08, 13, and the steel cylinders 24, 32, rotate at the production rotational speed FPRS, TPRS, SPRS. Three of the transfer cylinders 02, 11, 16 rotate in the same direction of rotation, for example rotating to the left, and are placed against the respectively associated steel cylinder 24 or 32. The two steel cylinders 24, 32 and the three forme cylinders 01, 09, 14 of the cylinder pairs 07, 08, 13 rotate in a direction of rotation opposite to this, for example to the right. The fourth forme cylinder 19 rotates at one of the set-up rotational speeds FSRS, for example at the rotational speed FPFCRS for changing the printing forme, or alternatively at the rotational speed FITRS for image transfer, and, in an advantageous manner, is moved away from the cooperating transfer cylinder 21. As shown in the example, the transfer cylinder 21 is not placed against the steel cylinder 32 and also rotates at one of its set-up rotational speeds TRRS, for example at the rotational speed TWRS for washing the transfer cylinder 21.

In an advantageous embodiment, the eighteenth example can be applied to a mode of operation, in which at least two of the cylinder pairs 07, 08, 13, 18, or the forme cylinders 01, 09, 14, 19, or the transfer cylinders 02, 11, 16, 21 rotate at one of their set-up rotational speeds FSRS, TRRS, for example, for the purpose of changing the printing forme or the dressing at the rotational speed FPFCRS or TDCRS, for the purpose of washing at the rotational speed TWRS or FWRS, for the purpose of pre-inking at the rotational speed FPIRS, or at the rotational speed FITRS for image transfer, while the remaining cylinders 01, 02, 09, 11, 14, 16, 19, 21, 24, 32 rotate at the production rotational speeds FPRS, TPRS, SPRS.

In a nineteenth example, the steel cylinders 24, 32 rotate at the rotational speed SDIRS, for example rotating to the right, for drawing in the web 06, which is not specifically represented in FIG. 7. The four transfer cylinders 02, 11, 16, 21 also rotate at the rotational speed TDIRS for drawing in the web, but with the opposite direction of rotation, for example rotating to the left. The forme cylinders 01, 09, 14, 19 rotate at one of their set-up rotational speeds FSRS, for example at the rotational speed FPFCRS for changing the printing forme, or alternatively at the rotational speed FITRS for image transfer. In this case, the direction of rotation can be to either the left or right. However, only one, two or three of the forme cylinders 01, 09, 14, 19 can rotate at the set-up rotational speeds FSRS, while the remaining ones are in the stopped state FZRS.

In a twentieth example, which is not specifically represented, inking rollers 04 cooperate with the forme cylinders 01, 09, 14, 19 from the nineteenth example. The inking rollers 04 have been placed against the forme cylinders 01, 09, 14, 19, which rotate at the rotational speed FPIRS for pre-inking and turn to the right, for example, and rotate at the rotational speed IPIRS for pre-inking, but in the opposite direction of rotation, for example toward the left.

It is of advantage in the described examples if at least the cylinders 01, 02, 09, 11, 14, 16, 19, 21, 24, 32, which rotate differently in the various examples, and in particular at different rotational speeds, are each driven by their own drive motor. In a preferred embodiment, all of the cylinders 01, 02, 09, 11, 14, 16, 19, 21, 24, 32 of the described printing units can be individually driven by their own drive motors without a driven coupling to another cylinder 01, 09, 11, 14, 16, 19, 21, 24, 32, or inking system. In that case, the drive motors then drive the respective cylinder 01, 02, 09, 11, 14, 16, 19, 21, 24, 32, or the inking system, during set-up operations, as well as during production.

The employment of position-regulated and/or rpm-regulated electric motors is of particular advantage. This also applies to the drives of the rollers 04, which can either have their own drive motor, or the inking system containing the roller 04 has a drive motor, which is independent of the cylinders 01, 02, 09, 11, 14, 16, 19, 21, 24, 32.

While preferred embodiments of a printing unit in accordance with the present invention have been set forth fully and completely hereinabove, it will be apparent to one of skill in the art that various changes in, for example the specific type of the web to be printed, the overall structure of the printing press in which the printing unit is placed and the like could be made without departing from the true spirit and scope of the present invention which is accordingly to be limited only by the following claims.

What is claimed is:

1. A web-fed printing unit comprising:

a first cylinder pair including a first forme cylinder and a first transfer cylinder;

a second cylinder pair including a second forme cylinder and a second transfer cylinder;

a satellite cylinder, said first and second transfer cylinders cooperating with said satellite cylinder in a print-on position of said web-fed printing unit; and a separate drive motor for each said forme cylinder and for each said transfer cylinder in each of said first and second cylinder pairs, each said drive motor for each said cylinder driving its own cylinder with no driving connection to other ones of said cylinders for rotation of each of said at least two cylinders of each said cylinder pair both during set-up and production of the printing unit, said satellite cylinder having a satellite cylinder draw-in rotational speed for drawing in a web which satellite cylinder draw-in speed is different from a zero rotational speed and from a production rotational speed, at least one of said first and second transfer cylinders simultaneously having a set-up rotational speed which transfer cylinder set-up rotational speed is different from a production rotational speed and from said zero rotational speed, said forme cylinder associated with said one transfer cylinder simultaneously having a set-up speed which forme cylinder set-up rotational speed is different from said production rotational speed and from said zero rotational speed, said forme cylinder and said transfer cylinder in each said cylinder pair each being simultaneously operable at a respective one of said speeds independently.

2. The printing unit of claim 1 wherein said printing unit is a five-cylinder printing unit.

3. The printing unit of claim 2 including a second five-cylinder printing unit, said first and second five-cylinder printing units cooperating to form a ten-cylinder printing unit.

4. The printing unit of claim 1 wherein the printing unit further includes a third cylinder pair including a third forme cylinder and a third transfer cylinder, said third transfer being adapted to cooperate with said satellite cylinder, the printing unit being a seven-cylinder printing unit.

5. The printing unit of claim 1 further including a third cylinder pair including a third forme cylinder and a third transfer cylinder and a fourth cylinder pair including a fourth forme cylinder and a fourth transfer cylinder, the printing unit being a nine-cylinder printing unit.

6. The printing unit of claim 5 wherein each of said first, second, third and fourth transfer cylinders has said set-up rotational speed.

7. The printing unit of claim 1 wherein each of said first and second transfer cylinders has said set-up rotational speed.

8. The printing unit of claim 1 wherein each said forme cylinder set-up rotational speed is equal to a speed for accomplishing a change of a printing forme on each said forme cylinder.

9. The printing unit of claim 1 wherein each said forme cylinder set-up rotational speed is equal to a rotational speed for image transfer to said forme cylinder.

10. The printing unit of claim 1 wherein each said forme cylinder set-up rotational speed is equal to a rotational speed for pre-inking said forme cylinder.

11. The printing unit of claim 1 wherein each said forme cylinder set-up rotational speed is equal to a rotational speed for dry-running said forme cylinder.

12. The printing unit of claim 1 wherein each said transfer cylinder set-up rotational speed is equal to a rotational speed for changing a dressing on said forme cylinder.

13. The printing unit of claim 1 wherein each said transfer cylinder set-up rotational speed is equal to a rotational speed for inking said associated forme cylinder.

14. The printing unit of claim 1 wherein each said transfer cylinder set-up rotational speed is equal to a rotational speed for washing said associated forme cylinder.

15. The printing unit of claim 1 wherein each said transfer cylinder set-up rotational speed is equal to a rotational speed for drawing a web into the printing unit.

16. The printing unit of claim 1 wherein each said drive motor is a position-regulated electric motor.

17. The printing unit of claim 1 wherein each said drive motor is an rpm-regulated electric motor.

18. The printing unit of claim 1 wherein said production rotational speed is determined by a desired circumferential speed.

19. The printing unit of claim 1 wherein said set-up rotational speed is determined by a desired circumferential speed.

20. A web-fed printing unit comprising:

a first cylinder pair including a first forme cylinder and a first transfer cylinder;

a second cylinder pair including a second forme cylinder and a second transfer cylinder;

a satellite cylinder, said first and second, transfer cylinders cooperating with said satellite cylinder in a print-on position of said web-fed printing unit; and a separate drive motor for each said forme cylinder and for each said transfer cylinder in each of said first and second cylinder pairs, each said drive motor for each said cylinder driving its own cylinder with no driving connection to other ones of said cylinders for rotation of each of said at least two cylinders of each said cylinder pair both during set-up and production of the printing unit, said satellite cylinder having a satellite cylinder production rotational speed, at least one of said first and second transfer cylinders simultaneously having a set-up rotational speed which differs from a production rotational speed which transfer cylinder set-up rotational speed differs from a transfer cylinder production rotational speed and a transfer cylinder zero rotational speed, said forme cylinder associated with said one of said transfer cylinders simultaneously having a forme cylinder set-up rotational speed which forme cylinder set-up rotational speed differs from a forme cylinder production rotational speed and from a forme cylinder zero rotational speed, said forme cylinder and said transfer cylinder in each said cylinder pair each being simultaneously operable at a respective one of said speeds independently.

21. The printing unit of claim 20 wherein said printing unit is a five-cylinder printing unit.

22. The printing unit of claim 21 further including a second five-cylinder printing unit, said first and second five-cylinder printing units cooperating to form a ten-cylinder printing unit.

23. The printing unit of claim 20 wherein the printing unit further includes a third cylinder pair including a third forme cylinder and a third transfer cylinder, said third transfer being adapted to cooperate with said satellite cylinder, the printing unit being a seven-cylinder printing unit.

24. The printing unit of claim 20 further including a third cylinder pair including a third forme cylinder and a third transfer cylinder and a fourth cylinder pair including a fourth forme cylinder and a fourth transfer cylinder, the printing unit being a nine-cylinder printing unit.

25. The printing unit of claim 24 wherein each of said first, second, third and fourth transfer cylinders has said set-up rotational speed.

26. The printing unit of claim 20 wherein each of said first and second transfer cylinders has said set-up rotational speed.

27. The printing unit of claim 20 wherein each said forme cylinder set-up rotational speed is equal to a speed for accomplishing a change of a printing forme on each said forme cylinder.

28. The printing unit of claim 20 wherein each said forme cylinder set-up rotational speed is equal to a rotational speed for image transfer to said forme cylinder.

29. The printing unit of claim 20 wherein each said forme cylinder set-up rotational speed is equal to a rotational speed for pre-inking said forme cylinder.

30. The printing unit of claim 20 wherein each said forme cylinder set-up rotational speed is equal to a rotational speed for dry-running said forme cylinder.

31. The printing unit of claim 20 wherein each said transfer cylinder set-up rotational speed is equal to a rotational speed for changing a dressing on said forme cylinder.

32. The printing unit of claim 20 wherein each said transfer cylinder set-up rotational speed is equal to a rotational speed for inking said associated forme cylinder.

33. The printing unit of claim 20 wherein each said transfer cylinder set-up rotational speed is equal to a rotational speed for washing said associated forme cylinder.

34. The printing unit of claim 20 wherein each said transfer cylinder set-up rotational speed is equal to a rotational speed for drawing a web into the printing unit.

35. The printing unit of claim 20 wherein each said drive motor is a position-regulated electric motor.

36. The printing unit of claim 20 wherein each said drive motor is an rpm-regulated electric motor.

37. The printing unit of claim 20 wherein said production rotational speed is determined by a desired circumferential speed.

38. The printing unit of claim 20 wherein said set-up rotational speed is determined by a desired circumferential speed.

39. A web-fed printing unit comprising:

a first cylinder pair including a first forme cylinder and a first transfer cylinder;

a second cylinder pair including a second forme cylinder and a second transfer cylinder;

a satellite cylinder, said first and second transfer cylinders cooperating with said satellite cylinder in a print-on position of said web-fed printing unit; and a separate drive motor for each said forme cylinder and for each said transfer cylinder in each of said first and second cylinder pairs, each said drive motor for each said cylinder driving its own cylinder with no driving connection to other ones of said cylinders for independent rotation of each of said at least two cylinders of each said cylinder pair both driving set-up and production of the printing unit, said satellite cylinder being in a stopped state while simultaneously at least one of said first and second transfer cylinders assigned to said satellite cylinder is operated at a transfer cylinder rotational speed for one of washing or pre-inking and said forme cylinder associated with said one of said transfer cylinders is operated at a forme cylinder set-up rotational speed, which forme cylinder set-up rotational speed differs from a productional rotational speed, and from a zero rotational speed, said forme cylinder and said transfer cylinder in each said cylinder pair each being simultaneously operable at a respective one of said speeds independently.

40. The printing unit of claim 39 wherein said printing unit is a five-cylinder printing unit.

41. The printing unit of claim 40 further including a second five-cylinder printing unit, said first and second five-cylinder printing units cooperating to form a ten-cylinder printing unit.

42. The printing unit of claim 39 wherein the printing unit further includes a third cylinder pair including a third forme cylinder and a third transfer cylinder, said third transfer being adapted to cooperate with said satellite cylinder, the printing unit being a seven-cylinder printing unit.

43. The printing unit of claim 39 further including a third cylinder pair including a third forme cylinder and a third transfer cylinder and a fourth cylinder pair including a fourth forme cylinder and a fourth transfer cylinder, the printing unit being a nine-cylinder printing unit.

44. The printing unit of claim 43 wherein each of said first, second, third and fourth transfer cylinders has said set-up rotational speed.

45. The printing unit of claim 39 wherein each of said first and second transfer cylinders has said set-up rotational speed.

46. The printing unit of claim 39 wherein each said forme cylinder set-up rotational speed is equal to a speed for accomplishing a change of a printing forme on each said forme cylinder.

47. The printing unit of claim 39 wherein each said forme cylinder set-up rotational speed is equal to a rotational speed for image transfer to said forme cylinder.

48. The printing unit of claim 39 wherein each said forme cylinder set-up rotational speed is equal to a rotational speed for pre-inking said forme cylinder.

49. The printing unit of claim 39 wherein each said forme cylinder set-up rotational speed is equal to a rotational speed for dry-running said forme cylinder.

50. The printing unit of claim 39 wherein each said drive motor is a position-regulated electric motor.

51. The printing unit of claim 39 wherein each said drive motor is an rpm-electric motor.

52. The printing unit of claim 39 wherein said production rotational speed is determined by a desired circumferential speed.

53. The printing unit of claim 39 wherein said set-up rotational speed is determined by a desired circumferential speed.

* * * * *